US010856634B2

(12) United States Patent
Sturm

(10) Patent No.: US 10,856,634 B2
(45) Date of Patent: Dec. 8, 2020

(54) CASE FOR A LENS OR TELESCOPE

(71) Applicant: Think Tank Photo, Inc., Santa Rosa, CA (US)

(72) Inventor: Michael Allen Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 51 days.

(21) Appl. No.: 16/239,436

(22) Filed: Jan. 3, 2019

(65) Prior Publication Data

US 2019/0200718 A1 Jul. 4, 2019

Related U.S. Application Data

(60) Provisional application No. 62/613,592, filed on Jan. 4, 2018.

(51) Int. Cl.

| | |
|---|---|
| ***A45C 11/08*** | (2006.01) |
| ***A45C 11/38*** | (2006.01) |
| ***A45F 5/02*** | (2006.01) |

(52) U.S. Cl.

CPC ..... *A45C 11/08* (2013.01); *A45C 11/38* (2013.01); *A45F 5/021* (2013.01); *A45F 2200/05* (2013.01)

(58) Field of Classification Search

CPC ..... A45C 11/08; A45C 11/38; A45F 5/021
USPC ..... 224/607; 383/97, 66, 41, 4
See application file for complete search history.

(56) References Cited

U.S. PATENT DOCUMENTS

| | | | | | |
|---|---|---|---|---|---|
| 2,730,151 | A | * | 1/1956 | Smith | A45C 3/00 383/12 |
| 4,878,606 | A | * | 11/1989 | Miller | A45F 3/14 224/625 |
| 4,923,060 | A | * | 5/1990 | Breslau | A45C 11/38 190/102 |
| 5,154,332 | A | * | 10/1992 | Williams | A45C 13/002 190/26 |
| 5,285,833 | A | * | 2/1994 | Haxby | A45C 1/04 150/102 |
| D344,852 | S | | 3/1994 | McManaman | |
| 5,373,980 | A | * | 12/1994 | Rowell | A45C 11/38 206/316.1 |
| 5,464,285 | A | * | 11/1995 | Anderson | A61F 15/001 383/10 |
| D376,064 | S | | 12/1996 | Glauth et al. | |
| D379,714 | S | | 6/1997 | Cerny et al. | |

(Continued)

OTHER PUBLICATIONS

Web page describing Fold-Over Neoprene Lens Pouch (MFR # LPN-F30X45) sold by Gradus Group LLC d/b/a Ruggard.

(Continued)

*Primary Examiner* — Nathan J Newhouse
*Assistant Examiner* — Lester L Vanterpool
(74) *Attorney, Agent, or Firm* — R. Dabney Eastham

(57) ABSTRACT

A case for a lens or telescope has a generally cylindrical side wall attached to a top wall and a bottom wall defining a compartment accessed by an opening extending across the top wall away from a belt mounting sleeve and down the side wall opposite the belt mounting sleeve. The top wall and the side wall are deformable to permit the opening to be enlarged by hand for insertion or removal of the lens or telescope. A zipper secures the opening. An additional opening may be provided at a juncture of the top wall and the side wall.

13 Claims, 6 Drawing Sheets

(56) References Cited

U.S. PATENT DOCUMENTS

| | | | | |
|---|---|---|---|---|
| D382,400 | S | 8/1997 | Theodosakis et al. | |
| D383,361 | S | 9/1997 | Melk | |
| D390,002 | S | 2/1998 | Brizard | |
| D397,550 | S | 9/1998 | Coughlin | |
| 5,810,166 | A * | 9/1998 | Weinreb | A45C 13/103 190/903 |
| D403,155 | S | 12/1998 | Liu | |
| D403,855 | S | 1/1999 | Champommier | |
| 5,864,289 | A * | 1/1999 | Tiemann | A45C 1/00 224/236 |
| 5,887,770 | A * | 3/1999 | Covell | A45C 13/30 150/102 |
| 5,927,581 | A * | 7/1999 | Reddy | A45F 3/02 224/153 |
| D415,390 | S | 10/1999 | Winnington-Ingram | |
| 6,109,495 | A * | 8/2000 | Hernandez | A45F 3/12 224/264 |
| 6,138,881 | A * | 10/2000 | Paul | A45F 3/02 224/153 |
| 6,357,640 | B1 * | 3/2002 | Rickard | A45C 1/04 150/150 |
| D474,887 | S | 5/2003 | Forster | |
| D491,357 | S | 6/2004 | Hassett | |
| D537,711 | S | 3/2007 | Limber | |
| 7,422,131 | B2 * | 9/2008 | Cohen | A45F 3/04 224/651 |
| 8,152,374 | B2 * | 4/2012 | Shaul | A45C 13/002 383/37 |
| 2004/0022455 | A1 * | 2/2004 | Reason | A45C 13/103 383/5 |
| 2005/0205635 | A1 * | 9/2005 | Cohen | A45C 13/103 224/652 |
| 2007/0102460 | A1 * | 5/2007 | Lottman | A45C 7/0059 224/153 |
| 2009/0266727 | A1 * | 10/2009 | Fair | A45C 11/38 206/316.2 |
| 2015/0068933 | A1 * | 3/2015 | So | A45C 11/38 206/316.1 |
| 2017/0258211 | A1 * | 9/2017 | Huang | A45F 5/021 |

OTHER PUBLICATIONS

Web page describing Lens Case (MFR#LCY-16X3) sold by Gradus Group LLC d/b/a Ruggard.
Web page describing Arc Lens Case 1.6 sold by GuraGear LLC d/b/a Tamrac.
Web page describing ACLC8 lens case sold by Norrazza, Inc. d/b/a Ape Case.
Web page describing ACPRO LC 16 lens case sold by Norrazza, Inc. d/b/a Ape Case.
Web page describing ACPRO LC 18 lens case sold by Norrazza, Inc. d/b/a Ape Case.
Web page describing Lens Case (SKU# LP 36306-PWW) sold by Vitec Holdings Italia Srl d/b/a Lowepro.
Web page describing Lens Case (SKU# LP 36304-OWW) sold by Vitec Holdings Italia Srl d/b/a Lowepro.
Web page describing S&F Lens Exchange Case 200AW (SKU# LP36260-OWW) sold by Vitec Holdings Italia Srl d/b/a Lowepro.
Web page describing Lens Drop lens pouch (SKU # 700189) sold by Think Tank Photo, Inc.
Web page describing Lens Changer lens pouch (SKU # 700055) sold by Think Tank Photo, Inc.
Web page describing Skin lens pouch (SKU # 700059) sold by Think Tank Photo, Inc.

* cited by examiner

CASE FOR A LENS OR TELESCOPE

CROSS-REFERENCE TO RELATED APPLICATIONS

This non-provisional application claims benefit and priority under 35 U.S.C. § 119(e) of U.S. provisional patent application Ser. No. 62/613,592, filed on Jan. 4, 2018 and titled "SOFT CASE FOR A LENS OR TELESCOPE," the contents of which are incorporated by reference for all purposes.

TECHNICAL FIELD

The field of the invention is that of carriers for articles, and particularly carriers made of flexible material for carrying instruments such as lenses and telescopes.

BACKGROUND ART

Many models of camera, particularly high quality cameras, have lenses that attach to the bodies of the cameras. The lenses can be removed from the bodies and other lenses attached. Modern single lens reflex cameras are of this sort of camera and can mount lenses of various types, such as telephoto and wide-angle lenses.

Photographers use cases to carry and protect lenses when the lenses are not attached to camera bodies. Such cases generally are "soft," meaning that these cases are made of neoprene synthetic rubber, such as the Neoprene Lens Pouch made by Gradus Group LLC doing business as Ruggard®, or fabric and padding sewn together, such as the cases made by a number of manufacturers.

A photographer using a camera with interchangeable lenses will want to be able to change lenses to suit the situation. She therefore will be likely to carry more than one lens. She may carry the lenses in cases to protect the lenses. She may attach the cases to a belt. This method of carrying the cases will provide convenient access to the lenses.

Cases for holding lenses may be open at the top, such as Think Tank Photo, Inc.'s Lens Drop™ lens pouch, which has a drawstring that tightens an internal flexible fabric throat near the entrance to the lens compartment. Tightening the flexible fabric throat will secure the lens. Alternatively, the cases may have a lid or door on top with a drawstring to secure the lid. Think Tank Photo, Inc.'s Lens Changer™ lens pouch, for example, has a hinged lid at the entrance to the lens compartment that can be secured over the lens by a drawstring. Both types of Think Tank Photo, Inc.'s lens cases provide quick access to the lens. The photographer can insert or remove the lens from such a case very quickly, using only one hand, and the drawstring (and lid, if present) will prevent the lens from falling out of the compartment. The lens in the compartment will be protected from dust and rain.

Think Tank Photo, Inc. also makes cases for carrying lenses, namely the Skin™ line of lens pouches, which have a drawstring closure at the opening to the compartment, and a top flap that covers the top of the pouch. The flap is secured in place by mating hook-and-loop patches on the flap and the body of the pouch. The flap will help protect the lens from rain and dust.

A soft lens case having a lid or door secured to the body of the case by a zipper would more securely contain the lens and be less susceptible to operator error in securing the lens. It would also provide more protection for the lens from the dust and the elements. An example of a lens case using a zipper to secure an opening to the compartment defined in the case is the Arc™ Lens Case sold by GuraGear LLC doing business as Tamrac®. This lens case has an opening secured by a zipper that extends up one side, over the top, and down the opposing side. The sides with the zipper are orthogonal to that side of the case that has a sleeve for attachment to a belt.

Some soft lens cases have hinged tops that are attached to the body of the lens case by a zipper running around the case from one side of the hinge to the other side of the hinge, and the hinge is located on the side of the case that has a flap or sleeve for attachment to a belt. Examples of such cases are padded lens cases (e.g., MFR # LCY-16X3) sold by Gradus Group LLC doing business as Ruggard®, padded lens cases (e.g., SKU LP36306-PWW) sold by Vitec Holdings Italia Srl doing business as Lowepro®, and the ACLC8 Lens Case made by Norazza, Inc. doing business as Ape Case®. However, fastening and unfastening the zipper would take more time than tightening and untightening a drawstring enclosure. The photographer has to pull the zipper slider along the zipper around the case. This is difficult to do with one hand.

Other manufacturers sell padded cases that provide access to the compartment by means of a flap with dual zippers running across the top of the case and down the side of the case opposite the side that has the flap or sleeve or other means for attachment to the user's belt. A strap attaches the sliders of the zippers to each other by a strap so that the user can open or close both zippers simultaneously. For example, Vitec Holdings Italia Srl doing business as Lowepro® offers its S&F Lens Exchange Case 200AW that can hold one or two lenses and is opened by pulling down on the strap attaching the zipper sliders to cause the flap to rotate down and away from the user's body when the case is mounted on a belt. Norazza, Inc. doing business as Ape Case® makes the ACPROLC18 lens case that has a lid that the user may open by pulling up on a strap attaching the dual zipper sliders to cause the flap to rotate up and toward the user's body when the case is mounted on a belt. Alternatively, the user can secure the lid of the ACPROLC18 lens case with an adjustable quick release clasp. These cases are complicated to make and require more materials.

The disclosures of the soft cases for lenses discussed above are incorporated by reference for all purposes allowed by law.

Telescopes are like telephoto lenses for cameras in the telescopes' shapes and need for protection. A case that can contain, carry, and protect a telescope will be useful for field use. Quick and easy access to the telescope will enable the user to deploy the telescope rapidly in order to view transient phenomena such as the appearance of wild animals and the like. A case for a telescope also presents the problem of providing both quick and easy access and protection of the telescope.

SUMMARY OF INVENTION

The invention provides a case for a lens or telescope that enables the user to withdraw the lens or telescope from the compartment of the case using only one hand. Likewise, the user can insert the lens or telescope into the compartment of the case with only one hand. A zipper secures the opening to the compartment in order to provide secure containment of the lens or telescope and good protection of the lens or telescope from dust and the elements. An additional opening and zipper may be provided for access to the compartment.

In an exemplary embodiment of the disclosure, a case for a lens or a telescope comprises a side wall attached to a top wall and a bottom wall to define a compartment adapted to receive a lens or telescope, the side wall, the top wall, and the bottom wall being made of a flexible material, the top wall having an opening defined in the top wall substantially bifurcating the top wall, the opening in the top wall and the opening in the side wall being contiguous and forming a first case opening, and a first zipper comprising a slider and zipper halves attached to the top wall and the side wall along the first case opening for closing the first case opening. Opening the zipper exposes the first case opening and the top wall and the side wall deform away from the first case opening to enlarge the case opening and the lens or telescope may be inserted into or removed from the compartment through the first case opening, and closing the zipper closes the first case opening and thereby secures the lens or telescope in the compartment. Preferably a means such as a sleeve is mounted on the side wall for attachment of the case to a belt, the opening defined in the top wall is orthogonal to the means for attachment of the case to a belt, and the opening defined in the side wall is opposite the means for attachment of the case to a belt. Means for attachment of a shoulder strap to the case may be mounted on one or more of the top wall and the side wall.

The case may have a second case opening in which the top wall is connected to the side wall by a hinge located at an intersection of the top wall and the side wall opposite the means mounted on the side wall for attachment of the case to a belt, a second case opening is defined between the top wall and the side wall on either side of the hinge, and a second zipper comprising a slider and zipper halves are attached to the top wall and the side wall along the second case opening for opening and closing the second case opening, and the first case opening bisects the hinge.

The means for attachment of the case to a belt may be a sleeve or its equivalent. The user may carry the case on a belt for ready access to the lens or telescope contained in the compartment of the case. The user pulls the zipper pull away from her body across the top wall and down that portion of the side wall that is opposite the portion of the side wall adjacent the belt and the user's body. The user then may spread the sides of the opening thus created with her fingers and reach through the opening into the compartment to grasp the lens of telescope. The user may then insert the lens or telescope back into the compartment through the opening when the opening is unzipped by pushing the lens or telescope through the sides of the opening. The case may have attachment points or anchors for attachment to a shoulder strap. A shoulder strap may be provided to support the larger lenses and telescopes.

BRIEF DESCRIPTION OF DRAWINGS

Other objects, features, and advantages of the present invention will become more fully apparent from the following detailed description of preferred embodiments, the appended claims, and the accompanying drawings in which:

DESCRIPTION OF EMBODIMENTS

Figure 1:
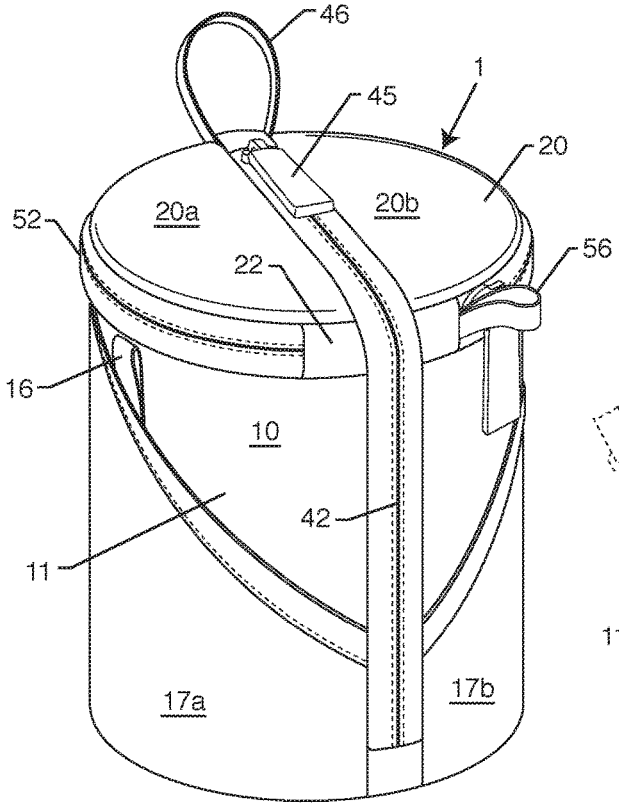
FIG. 1 is a right front perspective view of an embodiment of a case for a lens or telescope according to the invention.

The drawings show a preferred embodiment of a case for a lens or telescope 1 according to the disclosure. The case 1 has a side wall 10, a top wall 20 attached to the top of the side wall 10, and a bottom wall 30 attached to the bottom of the side wall 10 to define a compartment 5. The side wall 10, top wall 20, and bottom wall 30 preferably are made of two layers of fabric sandwiching a foam layer. The side wall 10, for example, has an outer fabric sheet 11 and an inner fabric sheet 12. The foam layers comprising the walls 10, 20, and 30 provide some protection against impact and give the case 1 enough rigidity to maintain its shape. These foam layers are not shown in the drawings for the sake of simplicity of presentation.

Persons of skill in the art will understand how to make walls for cases incorporating such foam layers. For example, the Think Tank Photo, Inc. lens pouches referenced in the "background art" section of this specification have walls with such construction. It will be understood that at least the side wall 10 and the top wall 20 may be made of any flexible or resiliently deformable material that provides protection from impact and maintains the environment for the articles to be carried in the compartment 5. Preferably the bottom wall 30 also is made of material of this description. The side wall 10 has sleeves 17A and 17B attached, such as by sewing, to form pockets that may be used to store small items such as lens caps and filters. Preferably the sleeves 17A and 17B are made of a flexible fabric or mesh material that will permit the insertion of the small objects between the sleeves 17A and 17B from above.

The compartment 5 defined in the case 1 has a generally cylindrical configuration that is adapted to contain a lens or telescope. The diameter and height of the case 1 can be varied in size to accommodate lenses of various diameters and lengths. A manufacturer may provide a line of cases 1 with varied diameters and heights in order for the user to be able to select a case 1 of appropriate size for the user's lens or telescope. Alternatively, the case 1 can be custom-made for the user's lens or telescope.

The term "generally cylindrical" will be understood to encompass case configurations adapted to provide compartments capable of receiving and holding lenses or telescopes. The case 1 shown in the drawings has a cylindrical configuration, meaning that the side wall 10 is formed like a cylinder and the compartment 5 likewise has a cylindrical shape.

However, other configurations would be encompassed by the term "generally cylindrical." For example, the side wall 10 could be formed to have a D-shaped cross-section in which the side wall 10 would have a flattened side, with the top wall 20 and bottom wall 30 conforming. The Lowepro padded lens case mentioned above in the Background Art section has such a configuration. The side wall 10 also could have a square cross-section. The Lowepro S&F Lens Exchange Case 200 AW case and the Ape Case ACPROLC18 case mentioned above in the Background Art section have such a configuration. The D-shaped and square cross-section configurations provide flat side wall portions with belt attachment means located where the side wall is intended to contact the user when the case is worn on a belt.

The case 1 shown in the drawings can be carried in a number of ways. For example, it could be inserted in a backpack or duffle bag. The case 1 may also be attached to a belt. A belt sleeve 15 is sewn to the exterior of the side wall 10 for accommodating a belt B. The belt B (shown in dashed line in FIG. 3) is inserted between the belt sleeve 15 and the outer fabric sheet 11. The belt sleeve 15 shown in the drawings is a simple one.

A more complex arrangement for attachment of the case 1 to a belt is provided by Think Tank Photo, Inc.'s "Rotate and Lock™" system that is disclosed in U.S. Pat. No. 7,770,770 B2. (The disclosure of U.S. Pat. No. 7,770,770 B2 is hereby incorporated by reference for all purposes allowed by law.) The Rotate and Lock™ system permits a case or pouch to be attached to a belt having loops in such a way that the case or pouch can be slid along the belt or fixed to it at chosen locations. Other configurations of sleeves for attachment to a belt are used by the cases discussed in the Background Art section above. The term "means mounted on the side wall for attachment of the case to a belt" is intended to encompass the structures provided by these background art cases, the Rotate and Lock™ system, the sleeve 15, and their equivalents.

Figure 2:
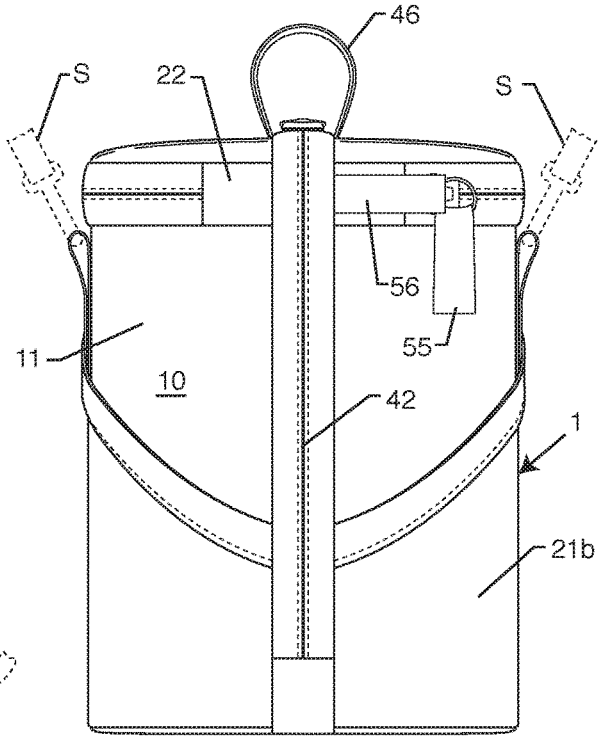
FIG. 2 is a front side view of the case of FIG. 1.

Alternatively or in addition, the case 1 may be suspended from a shoulder strap S (shown in dashed line in FIG. 2). The shoulder strap S may partially support the case 1 while the case 1 is attached to the belt B or it may wholly support the case 1. Cases for larger and heavier lenses and telescopes are more likely to need shoulder strap support.

The case 1 shown in the drawings has means for attachment to a shoulder strap. The anchors 16 are loops of webbing sewn to the side wall 10. Two anchors 16 are preferably spaced from each other on either side of the case 1. Snap clips at the ends of the shoulder strap S may be attached to the anchors 16. Alternatively, the anchors 16 could comprise D-rings attached to the side wall 10 such as by sewing a tape or webbing looped around the D-ring to the side wall 10, as in the Lowepro padded lens case mentioned above in the Background Art section. The shoulder strap S would then be attached to the D-rings. The term "means for attachment to a shoulder strap" is intended to encompass the loops 16 and the D-rings provided in the Lowepro padded lens case mentioned above in the Background Art section and their equivalents.

A belt sleeve 15 and anchors 16 may be provided together, as shown in the drawings, particularly for the larger sized cases, separately, or not at all. The details of the structures for attachment to a belt and to a shoulder strap may be varied, as a person of skill in the art will understand.

The compartment 5 may be accessed when the case 1 is opened. The case 1 preferably has two means for opening the case 1 to access the compartment 5. The case 1 has a first opening 40 defined in the side wall 10 and the top wall 20. The first opening 40 is shown to be closed in FIGS. 1-4 and 7-15. It is shown to be open in FIGS. 5 and 6.

The first zipper 42 provides the means for opening and closing the case 1 one handed. This will be the fastest way to open the case 1. The second zipper 42 provides an alternate means for opening and closing the case 1 as discussed below.

The first zipper 42 opens and closes the first opening 40 formed in the side wall 10 and the top wall 20. As best shown in FIGS. 1, 2, 8, and 10, the top wall 20 is attached to the side wall 10 by a hinge 22 that is sewn to both the top wall 20 and the side wall 10. The opening 40 divides the top wall 20 into two parts 20*a* and 20*b* on either side of the opening 40. The top wall 20 is generally circular (or D-shaped or square, as necessary to conform to the shape of the side wall 10).

Figure 5:
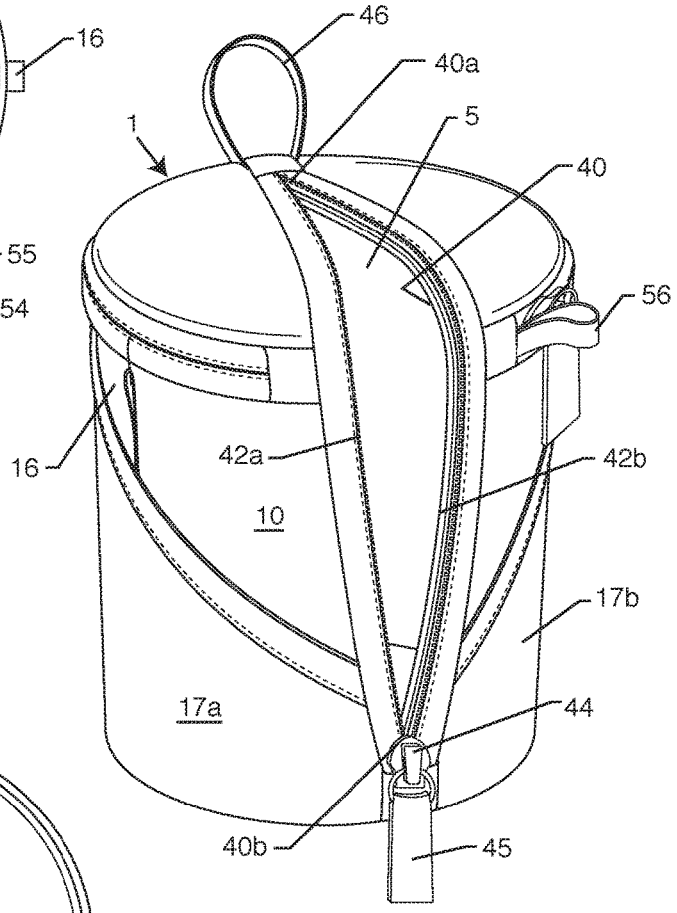
FIG. 5 is a right front perspective view of the case of FIG. 1 showing the longitudinal zipper opened.
Figure 6:
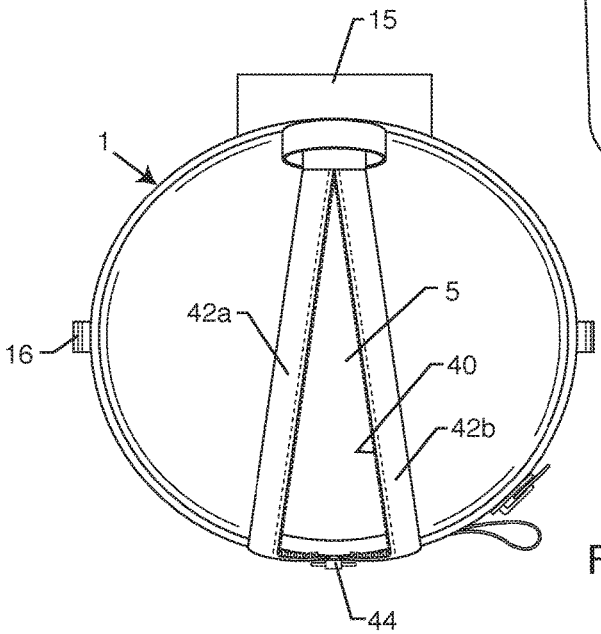
FIG. 6 is a top view of the case of FIG. 1 showing the longitudinal zipper opened.
Figure 7:
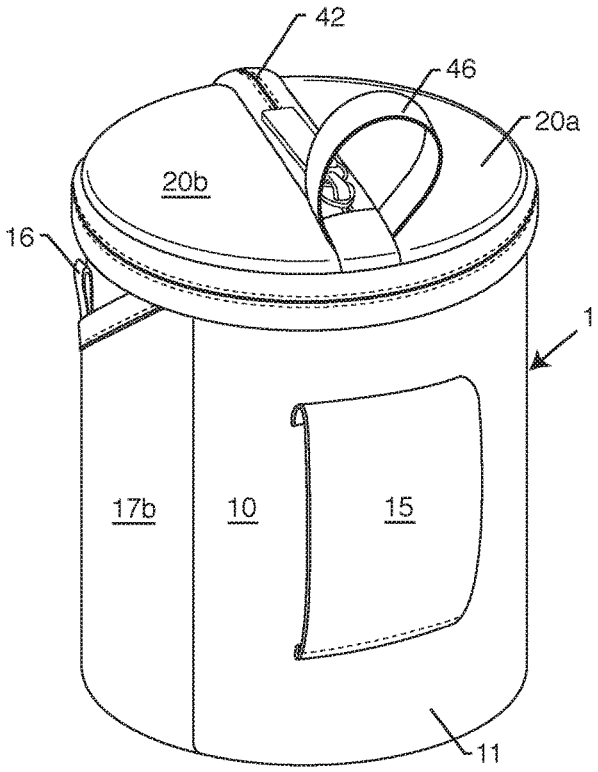
FIG. 7 is left rear perspective view of the case of FIG. 1.

The first opening 40 is formed along a diameter of the top wall 20, starting at the opening end 40*a* that is adjacent the portion of the side wall 10 to which the belt sleeve 15 is attached. The first opening 40 continues through the hinge 22 and down the side wall 10 to the opening end 40*b* adjacent the bottom wall 30. The opening ends 40*a* and 40*b* are shown in FIG. 5.

"Adjacent" in the context of the first opening 40 means that the positions of the opening ends 40*a* and 40*b* are sufficiently close to the portion of the side wall 10 to which the belt sleeve 15 is attached and to the bottom wall 30, respectively, to permit a lens or telescope of appropriate size to fit into the compartment 5 to be inserted and removed from the compartment 5. The first opening 40 thus divides the top wall 20 and the side wall 10 and will be the "quick-access opening."

The first zipper 42 is a continuous zipper that has two zipper sides 42*a* and 42*b* that are opened and closed by a slider 44. The slider 44 has a tab or extension 45, preferably made of tape or webbing or plastic tab or the like, attached to the slider 44. The tab or extension 45 permits the user to manipulate the slider 44. The first zipper 42 may be a conventional coil zipper such as those made by the YKK Corporation.

As mentioned above, the opening 40 can be expanded enough to permit passage of the lens or telescope, whether into the compartment 5 or out of it. The side wall 10 and the top wall 20 are resiliently deformable because they are made of flexible materials such as fabric and foam sheeting and therefore can permit the opening 40 to be enlarged.

Figure 3:
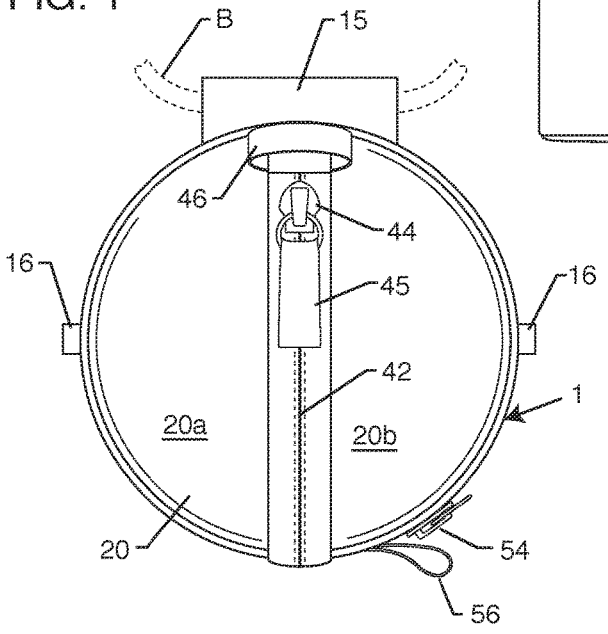
FIG. 3 is a top view of the case of FIG. 1.
Figure 4:
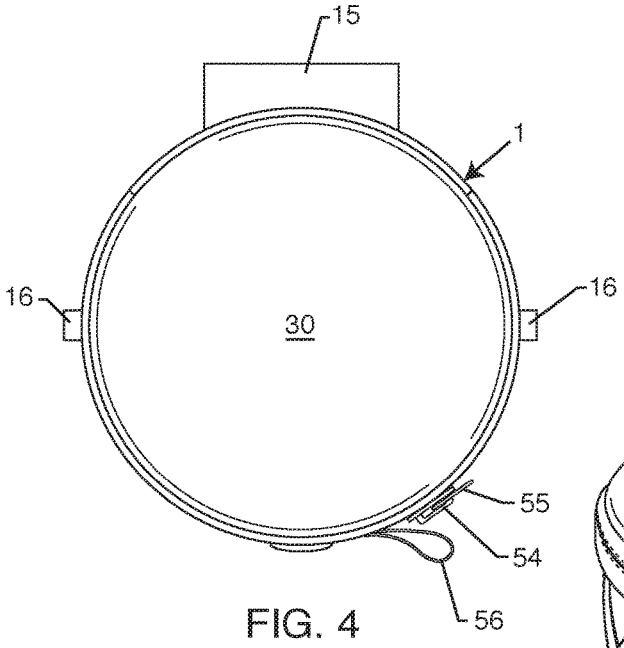
FIG. 4 is a bottom view of the case of FIG. 1.

Assuming the case 1 is closed as shown in FIGS. 1-3, the first zipper 42 is easily opened one-handed. The user grasps the tab or extension 45 with one hand and pulls it sideways across the top wall 20, and then down the side wall 10. Supposing the case 1 is attached to a belt B, each portion of this maneuver will cause the slider 44 to move first out and away from the belt B and then down from the belt B. The belt B, in effect, provides an anchor that the slider is pulled away from because the opening 40 in the top wall 20 is orthogonal or at a right angle to the belt B and the opening 40 in the side wall 10 is also orthogonal or at a right angle to the belt B.

Assuming that the closed case 1 is supported solely from a shoulder strap S, the first portion of the opening maneuver, in which the slider 44 moves from opening end 40*a* across the top wall 20, is anchored by the shoulder strap S because the case 1 will rotate on the anchors 16. The case 1 then rotates back to a more nearly vertical configuration during the second portion of the opening maneuver, in which the slider 44 moves toward the opening end 40*b* in the side wall 10, so that this portion is anchored by the shoulder strap S. The user is essentially pulling the tab 45 away from the shoulder strap S.

The user therefore opens the first opening 40 by sliding the slider 44 across the top wall 20 and down the side wall 10. This action will separate the zipper halves 42*a* and 42*b* from each other. The user will enlarge the first opening 40 by deforming the top wall 20 and the side wall 10 sufficiently to remove the lens or telescope.

The reverse operation, namely inserting the lens or telescope into the compartment 5, will now be described assuming that the first zipper 42 is open (meaning the zipper halves 42*a* and 42*b* are not secured to each other). The side wall 10 and the top wall 20 are deformed to widen the opening 40 by pushing the lens or telescope through the opening 40. The lens or telescope will be resting in the compartment 5 on the bottom wall 30 once the lens or telescope is in the compartment 5. The user can then close the opening 40 by pulling the slider 44 up the side wall 10 and across the top wall 20.

Assuming that a belt B supports the case 1, the belt will provide an anchor for the movement of the slider 44 up the side wall 10. The movement of the slider 44 across the top wall 20 will be anchored by the pressure of the user's waist against the case 1.

Assuming the case 1 is supported by a shoulder strap, the first and second portions of the movement of the slider 44 will tend to be anchored by the weight of the lens or telescope.

The loop 46 is attached to the top wall 20 near the opening end 40*a*. It preferably is made of webbing or plastic tape and is attached to the top wall 20 by sewing. The user can hold the loop 46 with one hand while pulling the slider 44 with the other hand in order to open the first zipper 42. The loop 46 will be especially helpful when opening the first zipper 42 when a belt B does not support the case 1.

Figure 8:
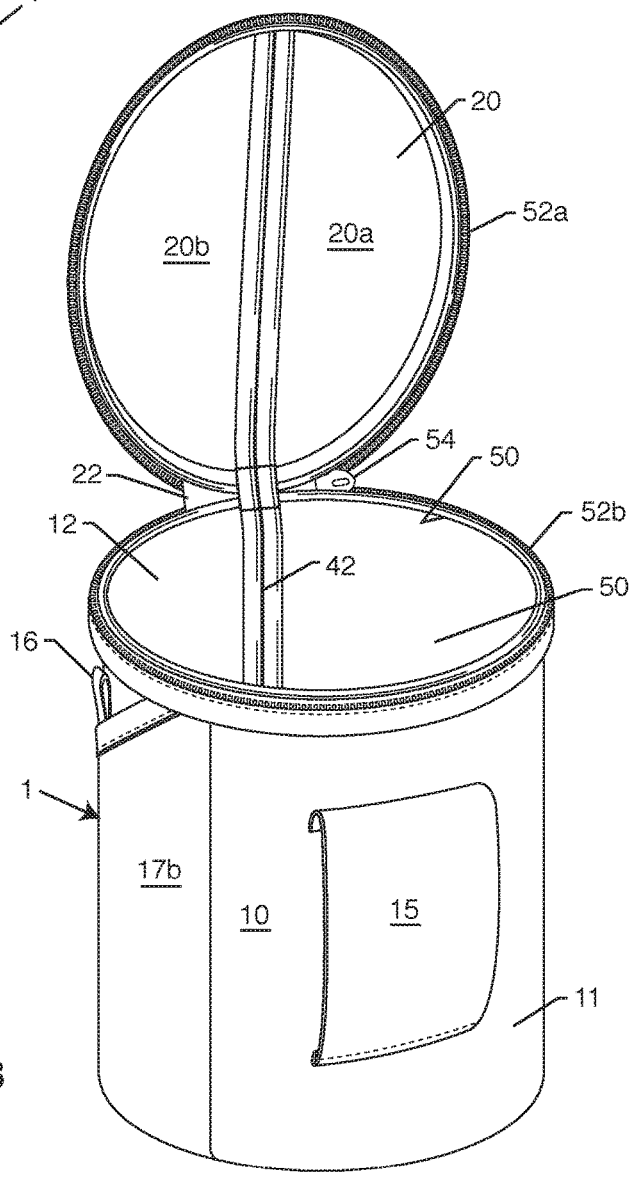
FIG. 8 is a left rear perspective view of the case of FIG. 1 with the radial zipper opened.
Figure 9:
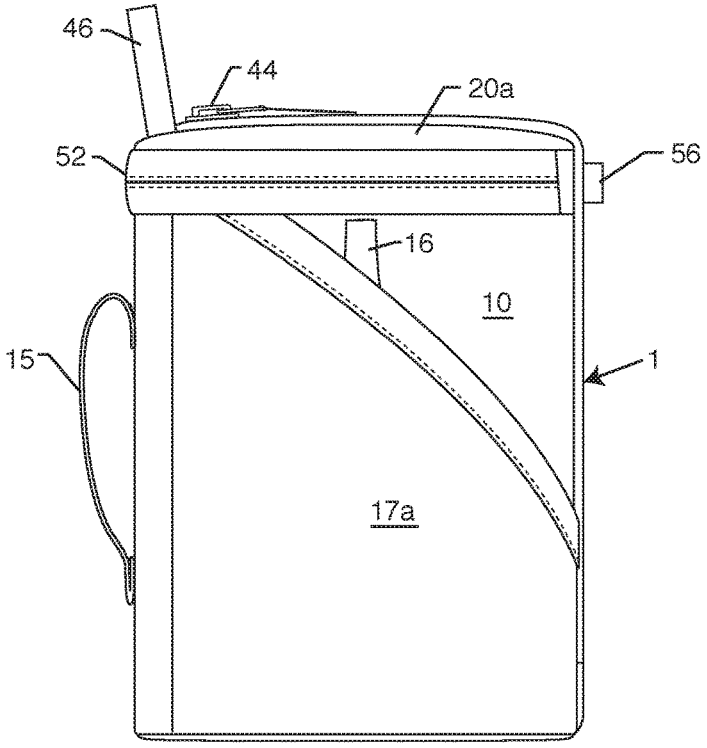
FIG. 9 is right side view of the case of FIG. 1.
Figure 10:
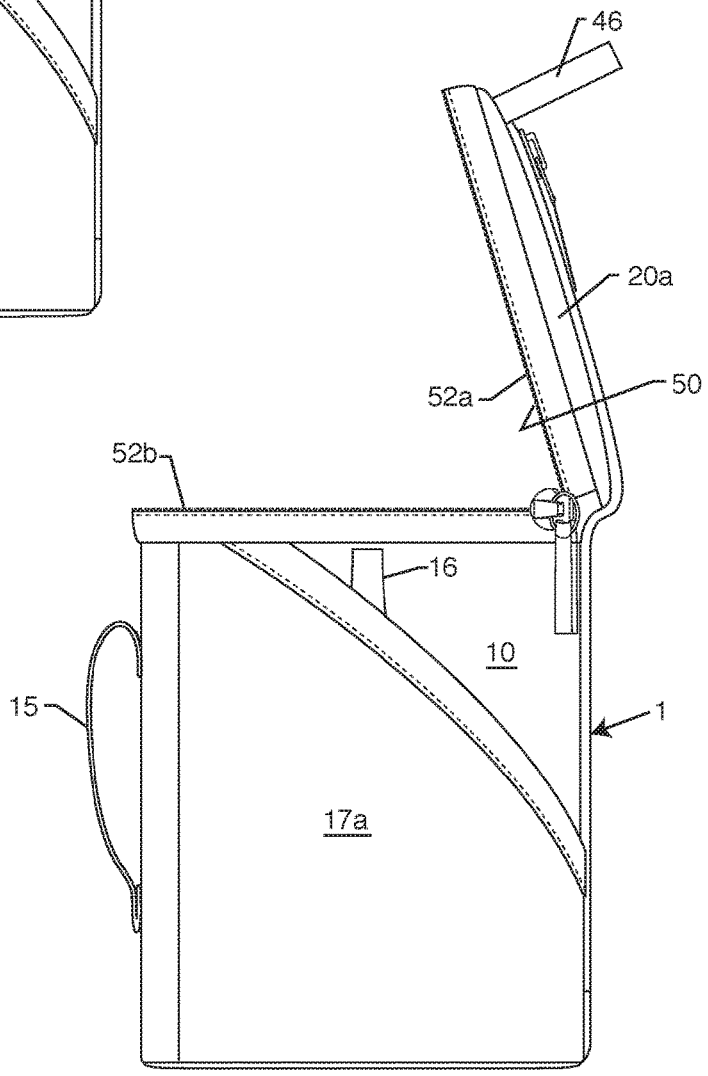
FIG. 10 is a right side view of the case of FIG. 1 with the radial zipper opened.
Figure 11:
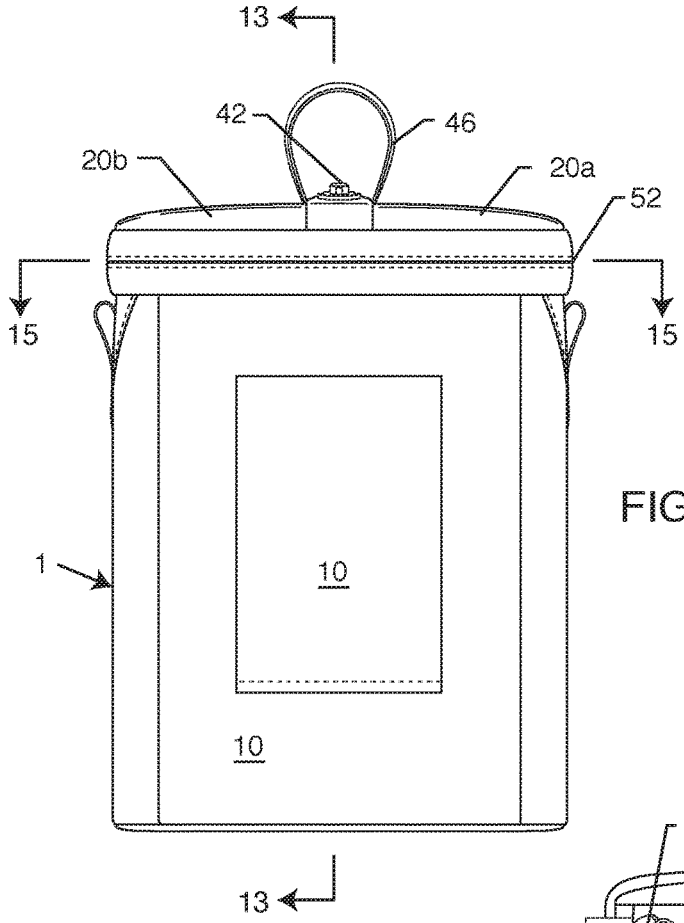
FIG. 11 is a rear side view of the case of FIG. 1.
Figure 12:
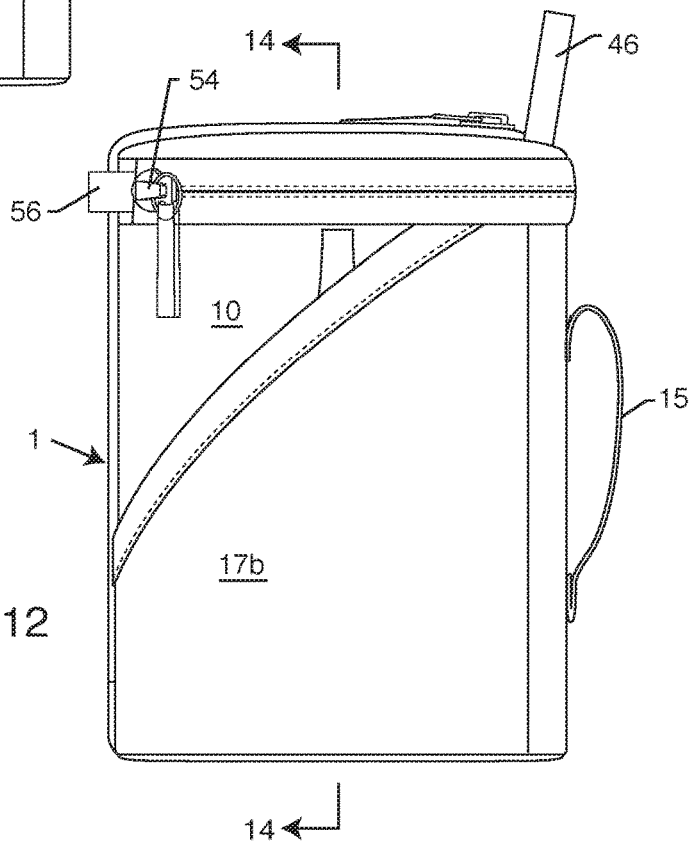
FIG. 12 is a left side view of the case of FIG. 1.
Figure 13:
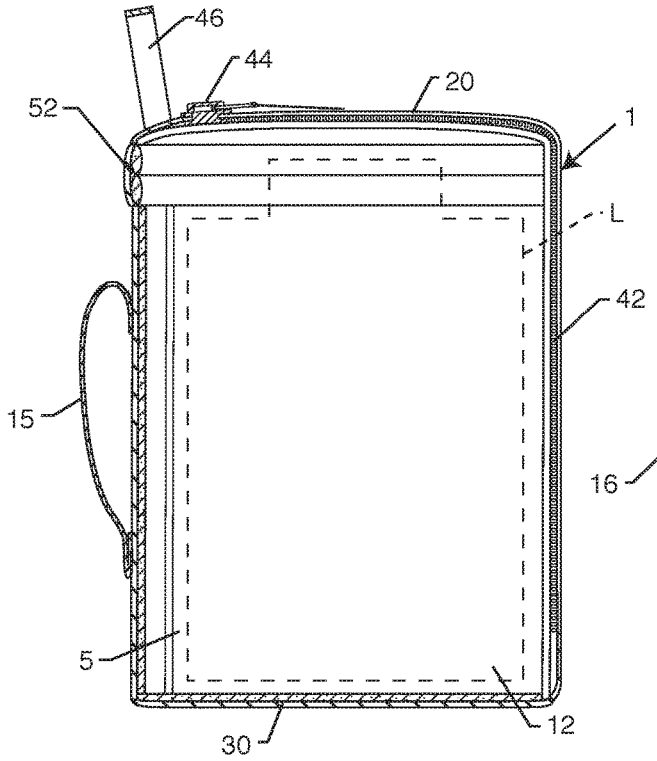
FIG. 13 is a cross-sectional view of the case of FIG. 1 taken on the plane 13-13 as shown in FIG. 11.
Figure 14:
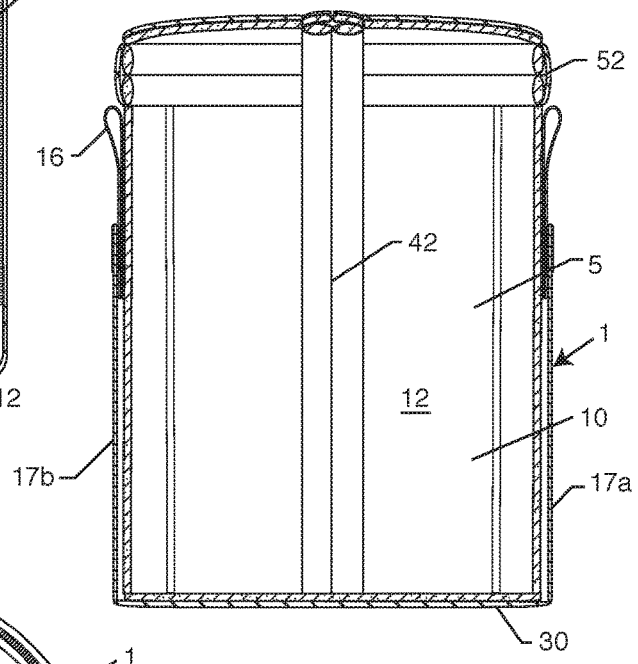
FIG. 14 is a cross-sectional view of the case of FIG. 1 taken on the plane 14-14 as shown in FIG. 12.
Figure 15:
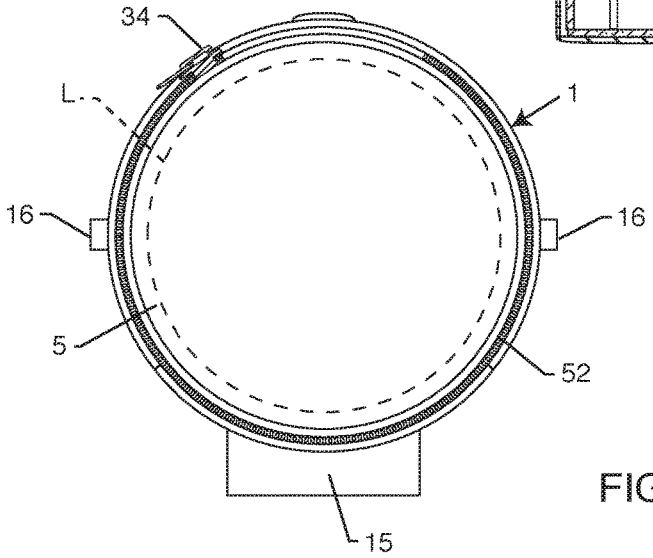
FIG. 15 is a cross-sectional view of the case of FIG. 1 taken on the plane 15-15 as shown in FIG. 11.

The side wall 10 and the top wall 20 are attached to each other at the hinge 22. The hinge 22 is sewn or otherwise attached to both the top wall 20 and the side wall 10 at a position spaced across from the means for attachment of the case to a belt and thus the body-contacting side of the case 1. The hinge 22 is not permanently attached to the side wall 10 and the top wall 20 except by the hinge 22. A second opening 50 therefore is provided at the juncture of the side wall 10 and the top wall 20 except where the top wall 20 and the side wall 10 are connected by the hinge 22. The opening 50 in case 1 is shown in FIGS. 8 and 10 and is closed in the other drawings.

A second zipper 42 is provided for the purpose of securing the second opening 50. The second zipper 42 has zipper halves 52*a* and 52*b* that are attached to each other and separated by the movement of the slider 54. The slider 54 has a tab or extension 55 that the user can grasp in order to pull the slider 55.

The loop 56 is attached to one side of the hinge 22 at one end of the second opening 50. It preferably is made of webbing or plastic tape and is attached to the hinge 22 by sewing. The user can hold the loop 56 with one hand while pulling the slider 44 with the other hand in order to open the second zipper 42.

The second opening 50 is a generally circular opening. As noted above, the side wall 10 may have a configuration other than that of a cylinder and therefore the shape of the second opening 50 would conform to the cross section of the side wall 10, such as D-shaped or the like. The user will have to draw the slider 54 in a circular motion, which is not as convenient for one-handed operation.

The second opening 50 as a means of access to the compartment 5 is an alternative to the first opening 40. The case 1 thus will have two openings for accessing the compartment 5, which is convenient. In another preferred embodiment of the case 1 the second opening 50 is omitted. In that embodiment the top wall 20 would be sewn to the side wall all along the periphery of the top wall 20 except at the opening 40 that is closed by the first zipper 42. The omission of the opening 50 from the case 1 will reduce the cost of making the case as well as saving materials, namely the hinge 22 and the second zipper 42.

While the invention has been described in conjunction with the preferred embodiment, it will be understood that it is not intended to limit the invention to this embodiment or its particular manner of construction, materials or components. For example, the case 1 could be adapted to hold a beer can or other generally cylindrical object.

The invention is intended to cover alternatives, modifications and equivalents that may be included within the spirit and scope of the invention as defined by the appended claims.

What is claimed is:

1. A case for a lens or telescope, comprising:

a side wall attached to a top wall and a bottom wall to define a compartment adapted to receive a lens or telescope, wherein the top wall is attached to the side wall by a hinge located at an intersection of the top wall and the side wall, the side wall and the top wall being made of one or more flexible materials, a means mounted on the side wall for attachment of the case to a belt, the top wall having an opening defined in the top wall bifurcating the top wall, the side wall having an opening defined in the side wall contiguous with the opening in the top wall wherein the opening in the side wall and the opening in the top wall together form a first case opening, the opening defined in the top wall is orthogonal to the means for attachment of the case to a belt and the opening in the side wall is disposed on the side wall opposite the means for attachment of the case to a belt, wherein the first case opening passes though the hinge, a first zipper comprising a slider and zipper halves being attached to the top wall and the side wall along sides of the first case opening for closing the first case opening, wherein opening the first zipper exposes the first case opening and the top wall and the side wall deform away from the first case opening to enlarge the first case opening and the lens or telescope may be inserted into or removed from the compartment through the first case opening, and closing the first zipper closes the first case opening and thereby secures the lens or telescope in the compartment.

2. The case according to claim 1 further comprising means for attachment mounted on one or more of the top wall and the side wall to a shoulder strap.

3. The case for a lens or telescope according to claim 1 wherein the first case opening bisects the hinge.

4. The case for a lens or telescope according to claim 1 wherein the hinge is attached to a position on the side wall opposite from the location on the side wall of the means mounted on the side wall for attachment of the case to a belt.

5. The case for a lens or telescope according to claim 4 wherein a second case opening is defined between the top wall and the side wall on either side of the hinge, and a second zipper comprising a slider and zipper halves is attached to the top wall and the side wall along the second case opening for opening and closing the second case opening.

6. A case for a lens or telescope, comprising:

a side wall attached to a top wall and a bottom wall to define a cylindrical compartment adapted to receive a lens or telescope, the side wall, the top wall, and the bottom wall being made of one or more flexible materials, a means mounted on the side wall for attachment of the case to a belt, the top wall having an opening defined in the top wall bifurcating the top wall, the opening defined in the top wall being orthogonal to the means for attachment of the case to a belt, the side wall having an opening defined in the side wall opposite the means for attachment of the case to a belt, the opening in the top wall and the opening in the side wall being contiguous and forming a first case opening, and a first zipper comprising a slider and zipper halves attached to the top wall and the side wall along the first case opening for closing the first case opening, wherein opening the first zipper exposes the first case opening and the top wall and the side wall deform away from the first case opening to enlarge the case opening and the lens or telescope may be inserted into or removed from the compartment through the first case opening, and closing the first zipper closes the first case opening and thereby secures the lens or telescope in the compartment, wherein the top wall is connected to the side wall by a hinge located at an intersection of the top wall and the side wall opposite the means mounted on the side wall for attachment of the case to a belt, a second case opening is defined between the top wall and the side wall on either side of the hinge, and a second zipper comprising a slider and zipper halves are attached to the top wall and the side wall along the second case opening for opening and closing the second case opening, and the first case opening bisects the hinge.

7. The case for a lens or telescope according to claim 6 further comprising means for attachment to a shoulder strap mounted on the side wall.

8. The case for a lens or telescope according to claim 6 wherein the side wall comprises inner and outer fabric layers sandwiching a foam layer.

9. The case for a lens or telescope according to claim 8 wherein the top wall comprises inner and outer fabric layers sandwiching a foam layer.

10. A method for carrying a lens or a telescope, comprising the steps of:

providing a case, wherein the case comprises a side wall attached to a top wall and a bottom wall to define a compartment adapted to receive a lens or telescope, the side wall and the top wall being made of one or more flexible materials, a means mounted on the side wall for attachment of the case to a belt, the top wall is attached to the side wall by a hinge located at an intersection of the top wall and the side wall and opposite the means mounted on the side wall for attachment of the case to a belt, the top wall having an opening defined in the top wall bifurcating the top wall, the side wall having an opening defined in the side wall contiguous with the opening in the top wall and opposite the means for attachment of the case to a belt, wherein the opening in the side wall and the opening in the top wall together form a first case opening, wherein the first case opening passes though the hinge, and a first zipper comprising a slider and zipper halves attached to the top wall and the side wall along sides of the first case opening for closing the first case opening, opening the first zipper to expose the first case opening, deforming the top wall and the side wall away from the first case opening to enlarge the first case opening, inserting the lens or telescope into the compartment through the first case opening, closing the first zipper and thereby securing the lens or telescope in the compartment.

11. The method for carrying a lens or a telescope according to claim 10 further comprising the step of attaching the case to a user's belt by attaching the belt to the means mounted on the side wall for attachment of the case to a belt wherein the case may be supported from the user's belt.

12. The method for carrying a lens or telescope according to claim 11 wherein the case includes a means for attachment to a shoulder strap mounted on one or more of the side wall and the top wall and further comprising the step of attaching a shoulder strap to the means for attachment to a shoulder strap mounted on one or more of the side wall and the top wall wherein the weight of the case may be supported at least in part by the shoulder strap.

13. The method for carrying a lens or telescope according to claim 11 wherein a second case opening is defined between the top wall and the side wall on either side of the hinge, and a second zipper comprising a slider and zipper halves is attached to the top wall and the side wall along the second case opening for opening and closing the second case opening, further comprising the steps of closing the first zipper to close the first opening if the first zipper is open, opening the second zipper to expose the second case opening, rotating the top wall along the hinge away from the side wall and away from the means for attachment of the case to a belt in order to enlarge the second case opening, inserting the lens or telescope into the compartment through the second case opening, and closing the second zipper and thereby securing the lens or telescope in the compartment.

* * * * *